US005608512A

United States Patent [19]

Endo

[11] Patent Number: 5,608,512

[45] Date of Patent: Mar. 4, 1997

[54] FIXING DEVICE HAVING A PIVOTALLY MOVABLE SEPARATING MEMBER

[75] Inventor: Saijiro Endo, Tokyo, Japan

[73] Assignee: Canon Kabushiki Kaisha, Tokyo, Japan

[21] Appl. No.: 567,807

[22] Filed: Dec. 6, 1995

Related U.S. Application Data

[63] Continuation of Ser. No. 201,558, Feb. 24, 1994, abandoned.

[30] Foreign Application Priority Data

Feb. 26, 1993 [JP] Japan ..... 5-061250

[51] Int. Cl.[6] ..... G03G 21/00

[52] U.S. Cl. ..... 399/323; 399/339

[58] Field of Search ..... 355/282, 285, 355/289, 290, 295, 315; 271/307

[56] References Cited

U.S. PATENT DOCUMENTS

| | | | |
|---|---|---|---|
| 4,384,781 | 5/1983 | Takada | 355/290 |
| 4,829,931 | 5/1989 | Mogi | 355/289 X |
| 4,933,726 | 6/1990 | Moriyama | 355/289 X |
| 5,142,339 | 8/1992 | Kasahara et al. | 355/282 |
| 5,287,153 | 2/1994 | Senba | 355/284 |
| 5,289,246 | 2/1994 | Menjo | 355/285 |
| 5,293,202 | 3/1994 | Adachi et al. | 355/282 |
| 5,331,385 | 7/1994 | Ohtsuka et al. | 355/290 |

*Primary Examiner*—Sandra L. Brase
*Attorney, Agent, or Firm*—Robin, Blecker, Daley & Driscoll

[57] ABSTRACT

A fixing device has a fixing member for conveying a recording medium while holding the recording medium thereon, and fixing an image on the recording medium, a separating member having a pivot shaft and urged against the surface of the fixing member, and a guide member provided downstream of the separating member with respect to the direction of movement of the recording medium for guiding the recording medium. The separating member is of such a shape that the portion thereof from the leading end of the recording medium to an imaginary line substantially perpendicular to the direction of movement of the recording medium and passing through the pivot shaft is along the direction of conveyance of the recording medium, and the portion thereof which is downstream of the imaginary line with respect to the direction of movement of the recording medium gradually becomes far from the movement path of the recording medium.

3 Claims, 5 Drawing Sheets

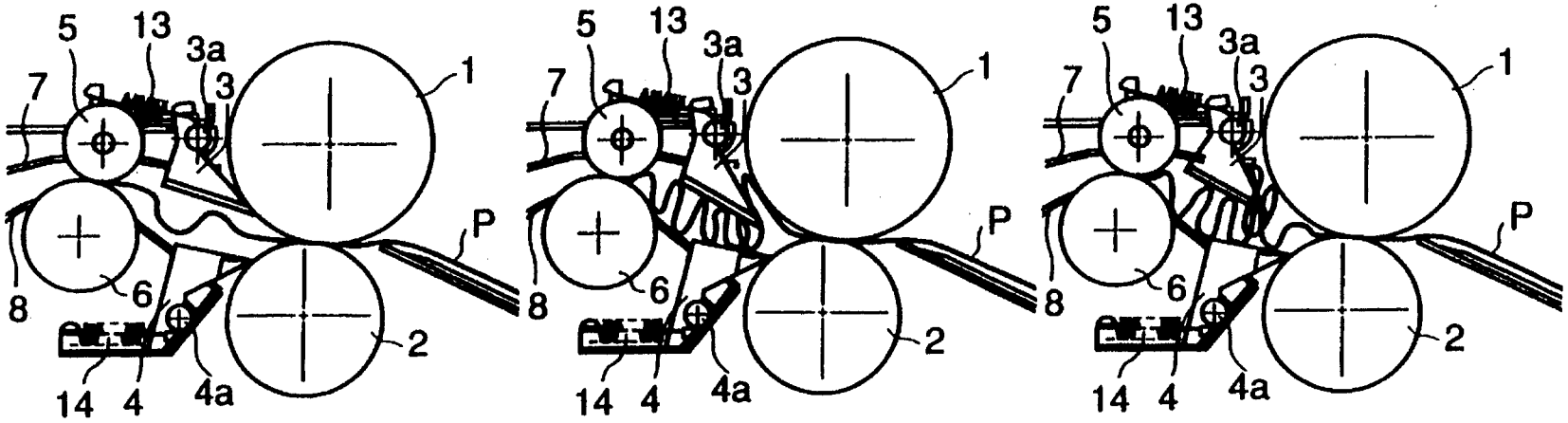
FIG. 4(a)
FIG. 4(c)
FIG. 4(e)
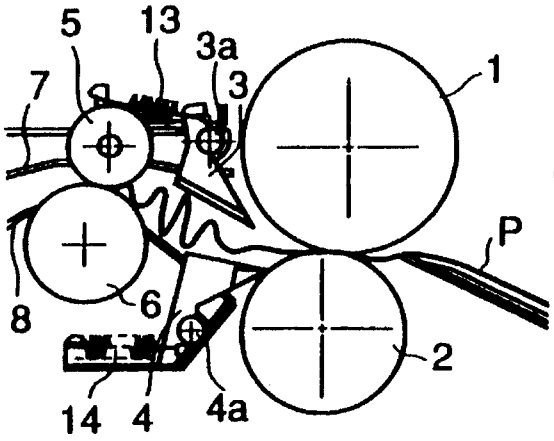
FIG. 4(b)
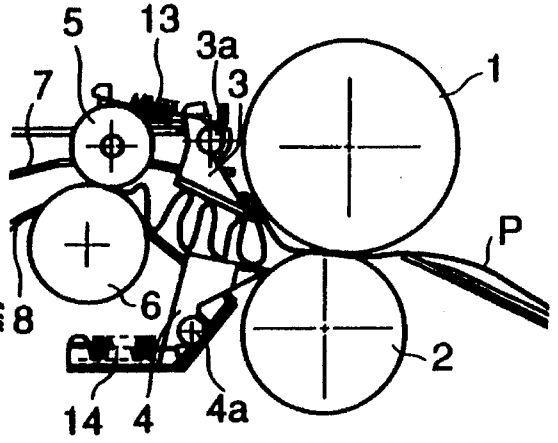
FIG. 4(d)

FIXING DEVICE HAVING A PIVOTALLY MOVABLE SEPARATING MEMBER

This is a continuation application under 37 CFR 1.62 of prior application Ser. No. 08/201,558 filed on Feb. 24, 1994 (abandoned).

BACKGROUND OF THE INVENTION

1. Field of the Invention

This invention relates to a fixing device for use in an image forming apparatus such as a copying apparatus or a printer.

2. Related Background Art

FIG. 3 of the accompanying drawings shows an example of an image forming apparatus. When the image forming operation is started in this apparatus, a signal is first sent to a laser transmitter by a controller (not shown) and a laser beam is emitted. This laser beam is then reflected by a mirror 9 (generally called a polygon mirror) which is rotating, and is further turned back by a reflecting mirror 10, whereby the laser beam is applied onto a photosensitive drum 12.

By such a series of operations, a so-called latent image is formed on the photosensitive drum 12, and this latent image is developed by a developing apparatus 11, whereafter the developed image is transferred as a toner image onto a recording medium.

Sheets of paper as recording mediums are supplied one by one from a paper cassette by a pickup roller 13 and pass under the photosensitive drum 12. A toner image is transferred onto a sheet of paper by the aforedescribed process as the sheet of paper passes. Thereafter, the sheet of paper is directed to a pair of fixing rollers 1 and 2, is urged by the pair of fixing rollers and is heated by the heat of heaters provided in the rollers whereby the toner image is fixed on the sheet of paper. An upper fixing separating pawl 3 and a lower fixing separating pawl 4 are in contact with the fixing rollers 1 and 2, respectively, whereby the sheet of paper is separated from the fixing rollers 1 and 2. The separated sheet of paper is conveyed to the outside of the apparatus body by a pair of paper discharge rollers 5 and 6, thus terminating the image forming process.

The upper fixing separating pawl 3 and the lower fixing separating pawl 4 adopt a construction as shown in (a) of FIG. 4 of the accompanying drawings. That is, the separating pawls 3 and 4 are pivotally movable about centers of rotation 3*a* and 4*a*, respectively, and are urged against the rollers by tension springs 13 and 14, respectively. Accordingly, when the leading end of the sheet of paper is jammed by some cause or other, the sheet of paper continues to be conveyed until the jamming of the paper is detected by paper detecting means (not shown) on the downstream side and the driving of the body is stopped. Therefore, the sheet of paper is jammed into an accordion-like shape between an upper paper discharge guide 7 and a lower paper discharge guide 8. At that time, as shown in (b) of FIG. 4 of the accompanying drawings, the sheet of paper jammed into the accordion-like shape pushes up the rear end portion of the upper fixing separating pawl 3 and therefore, the separating pawl is rotated and the tip end of the separating pawl becomes separated from the fixing roller 1. As the process further proceeds to (c) and (d) of FIG. 4 of the accompanying drawings, the sheet of paper is forced into a gap formed between the tip end of the separating pawl 3 and the fixing roller 1, and finally, as shown in (e) of FIG. 4 of the accompanying drawings, the sheet of paper jammed into the accordion-like shape will break the tip end of the separating pawl.

Usually, the tip end of the separating pawl is sharply formed into an "r" shape of several tens of μm and is weak in strength. This may lead to the possibility that the paper will pierce the tip end to thereby damage the shape of the tip end. There has also been a problem that the paper pierces the tip end of the separating pawl to thereby make it difficult to eliminate the jammed paper. A similar problem arises with regard also to the lower fixing separating pawl 4. A similar problem also arises in a drum separating pawl which is in contact with the photosensitive drum to separate the paper from the photosensitive drum.

In order to solve such problems, it would be possible to adopt a construction as shown in FIG. 5 of the accompanying drawings. That is, the rear end portions of the upper separating pawl 3 and lower separating pawl 4 are constructed so as to be covered with the portions 7*a* and 8*a* of the upper paper discharge guide 7 and lower paper discharge guide 8, respectively.

By the adoption of such a construction, even if the paper is jammed into an accordion-like shape when it just leaves the pair of fixing rollers 1 and 2, it will become difficult for the paper to push the rear ends of the separating pawls and therefore, it will become difficult for the phenomenon as noted above to occur.

However, even if such a construction is adopted, there are some gaps for permitting the pivotal movement of the separating pawls between the upper paper discharge guide 7 and the separating pawl 3 and between the lower paper discharge guide 8 and the separating pawl 4, and if the paper comes into these gaps, the rear ends of the separating pawls 3 and 4 will be pushed in the same manner as described above and the tip end of the separating pawl will become separated from the fixing roller 1.

Also, the guide plates 7 and 8 usually formed by metal sheets are inferior in slidability relative to the paper P, as compared with the surfaces of the separating pawls, and this gives rise to the problem that the guide plates scrape off the image on the surface of the paper P to thereby damage the image. Further, it is generally known that when the paper P is heated by the fixing roller 1, the moisture in the paper evaporates and is condensed on the upper and lower paper discharge guides 7 and 8 formed by metal sheets, and by the guide plates adopting the shapes as shown in FIG. 5, waterdrops created by the condensation become ready to adhere to the paper. The waterdrops adhering to the paper remarkably hamper the conveyance of the paper conveyed between the guide plates and therefore cause the paper to be jammed.

SUMMARY OF THE INVENTION

It is an object of the present invention to provide a fixing device in which the separation of a separating member from a fixing roller when jamming occurs is prevented.

It is another object of the present invention to provide a fixing device having a fixing member for conveying a recording medium while holding the recording medium thereon, and fixing an image on the recording medium, a separating member having a pivot shaft and urged against the surface of the fixing member, and a guide member provided downstream of the separating member with respect to the direction of movement of the recording medium for guiding the recording medium, the separating member being of such a shape that the portion thereof from the leading end of the recording medium to an imaginary line substantially perpendicular to the direction of movement of the recording medium and passing through the pivot shaft is along the direction of conveyance of the recording medium, and the portion thereof which is downstream of the imaginary line with respect to the direction of movement of the recording medium gradually becomes far from the movement path of the recording medium.

Further objects of the present invention will become apparent from the following description.

BRIEF DESCRIPTION OF THE DRAWINGS

FIGS. 4(*a*) through 4(*e*) sequentially illustrate the jammed state of paper in a fixing device.

DETAILED DESCRIPTION OF THE PREFERRED EMBODIMENTS

A fixing device according to an embodiment of the present invention will hereinafter be described.

Figure 3:
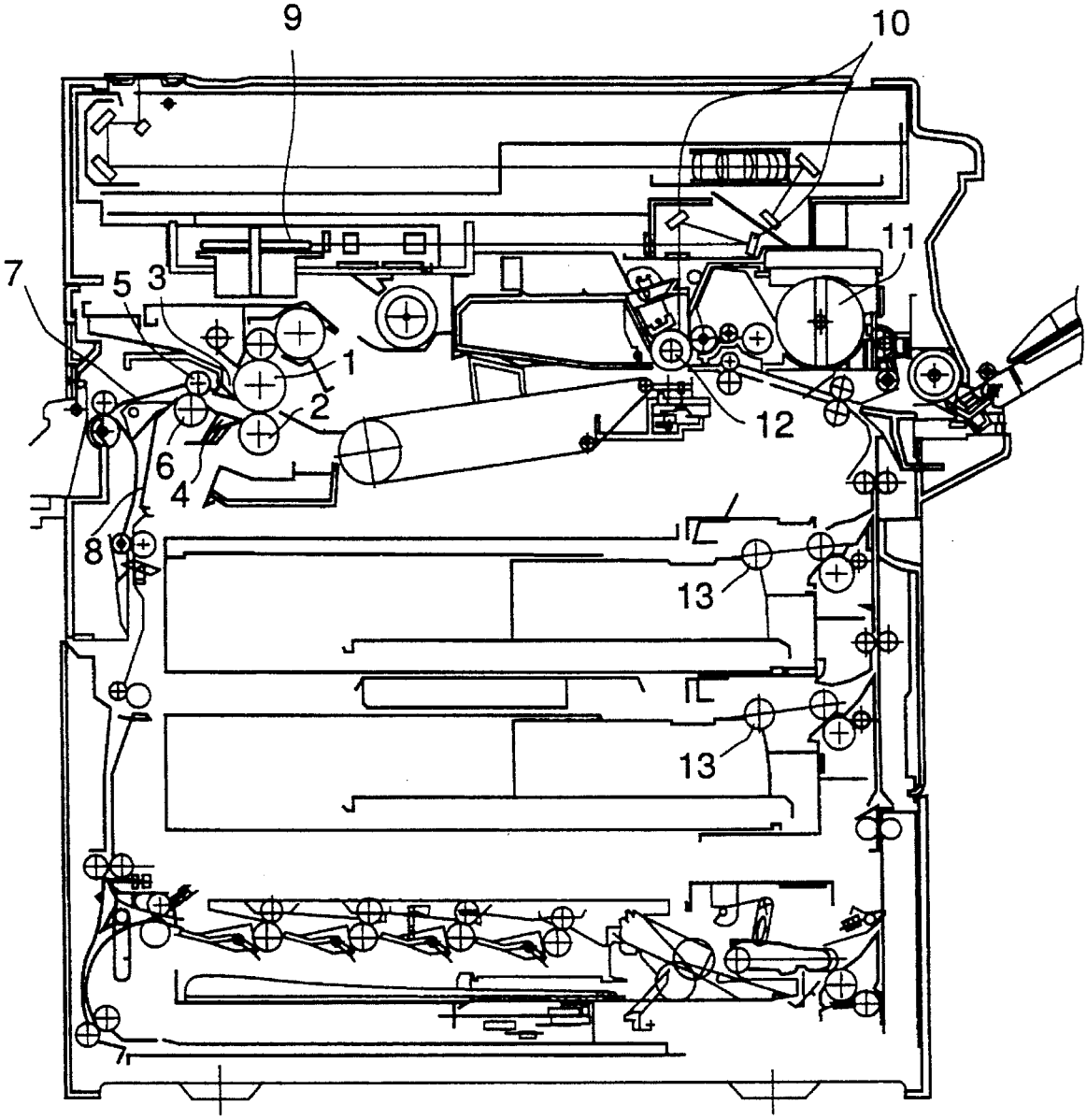
FIG. 3 is a cross-sectional view schematically showing the construction of an image forming apparatus.
Figure 5:
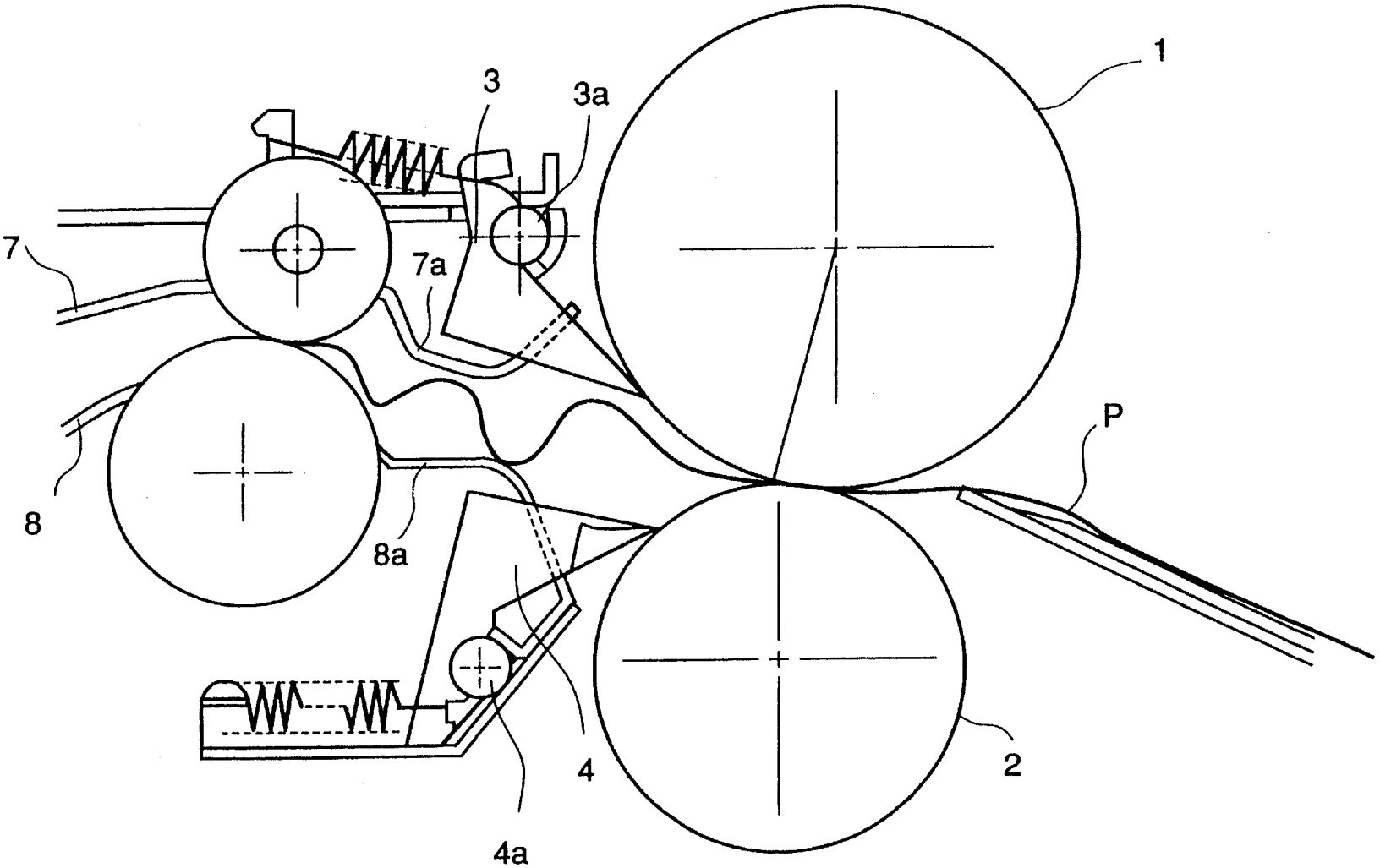
FIG. 5 shows the jammed state of paper in the fixing device.

An image forming apparatus in which the fixing device according to the present embodiment is similar to that shown in FIG. 3.

Figure 1:
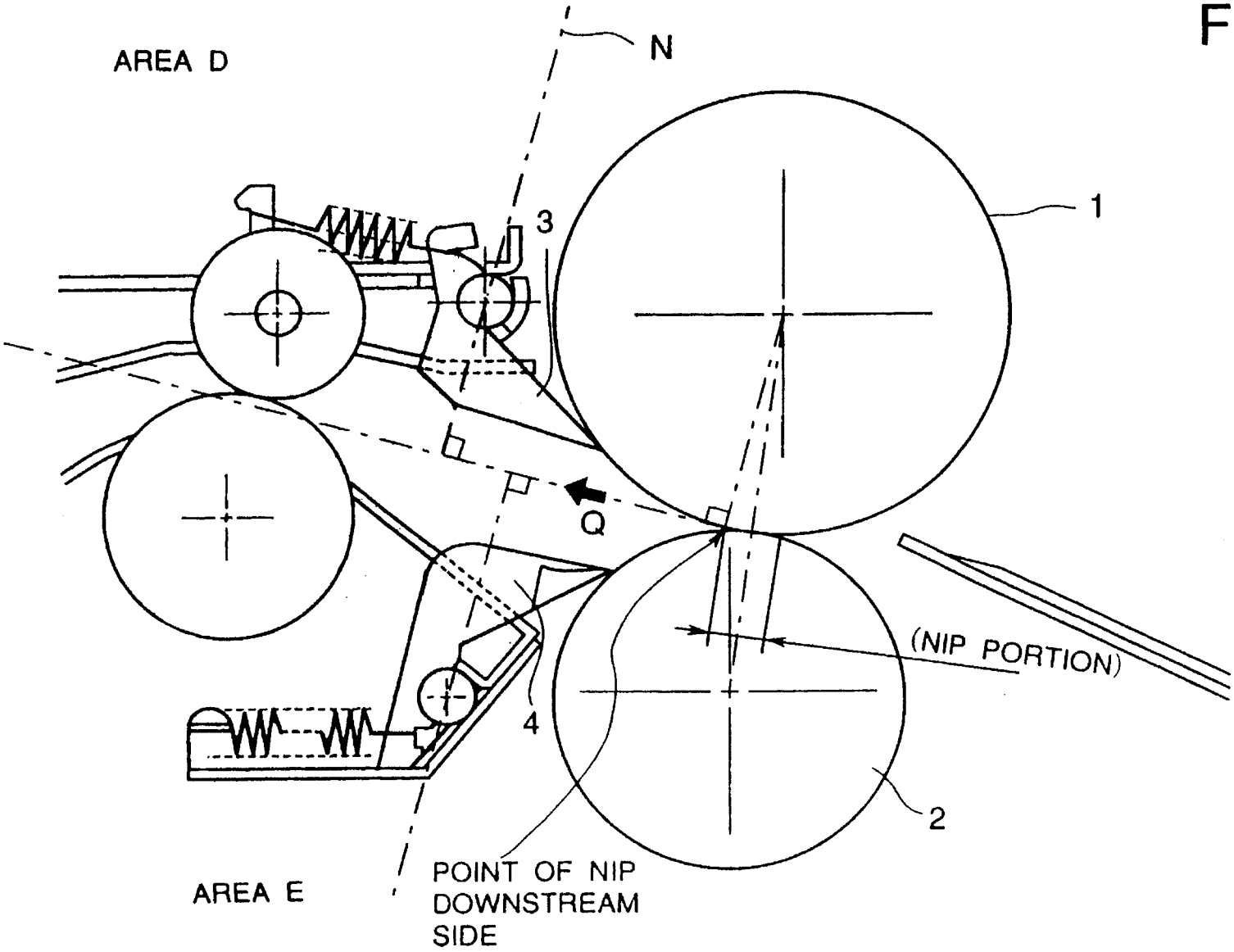
FIG. 1 is a cross-sectional view schematically showing the construction of a fixing device according to Embodiment 1 of the present invention.

FIG. 1 is a cross-sectional view of the fixing device according to the present embodiment.

A separating member used in the present embodiment is such that in the portion thereof from the tip end thereof bearing against a fixing roller to the vicinity of an imaginary line perpendicular to the direction of movement of a recording medium and passing through the pivot shaft of the separating member, the surface of the separating member adjacent to the recording medium is substantially parallel to the direction of movement of the recording medium. Therefore, the recording medium separated by the separating pawl is guided by the underside of the separating pawl.

Also, in order not to create any angular moment in the separating pawl, the rear end of the separating pawl is generally of such a shape that it will be far from the direction of movement of the paper in an area D which is downstream of a perpendicular N from the center of rotation of the separating pawl with respect to the direction of movement (the direction of arrow Q in FIG. 1) of the paper determined by the angles of a pair of fixing rollers 1 and 2. In this case, the direction of movement of the paper is approximated by the tangential line between the fixing rollers at a point of nip downstream side in the nip portion formed by the pair of fixing rollers 1 and 2.

The lower fixing separating pawl also is of a construction similar to that of the upper fixing separating pawl, and the rear end thereof is arcuately formed in an area indicated by E.

The separating pawls are of such a shape that even when the paper is jammed, it is difficult for the rear ends of the separating pawls to be pushed by the jammed paper, and any angular moment is not ready to occur in the separating pawls. Thus, even when the paper is jammed, the tip ends of the separating pawls will not separate from the fixing rollers and no gap will be formed between the separating pawls and the fixing rollers.

Also, due to the absence of the gap, the paper will be jammed into an accordion-like shape only between the upper paper discharge guide and the lower paper discharge guide and thus, the possibility of the jammed paper piercing the tip ends of the separating pawls will become very low, and the jammed paper will not damage the separating pawls. Also, the jammed paper can be smoothly removed.

[Embodiment 2]

Figure 2:
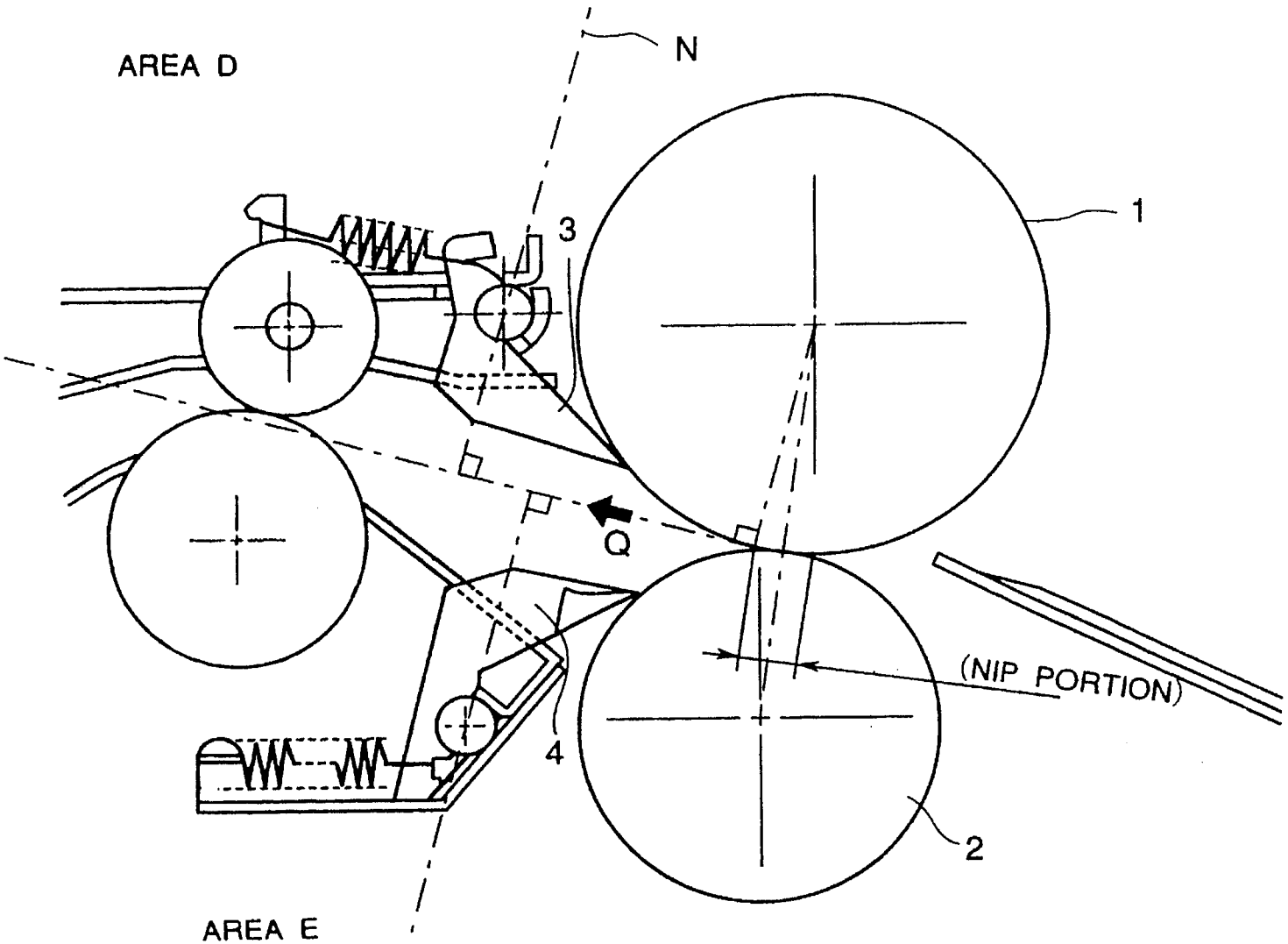
FIG. 2 is a cross-sectional view of the essential portions of a fixing device according to Embodiment 2 of the present invention.

Embodiment 2 of the present invention will now be described with reference to FIG. 2. In FIG. 2, portions common to those in FIG. 1 are given the same reference characters and need not be described.

In Embodiment 1, the rear ends of the pawls have been shown as an arcuate shape, whereas this is not restrictive, but the rear ends can assume a shape as shown, for example, in FIG. 2.

Also, in the embodiments, the separating pawls for separating the paper from the pair of fixing rollers have been described. However, a separating pawl for separating paper from a roller-like member, for example, a separating pawl for separating paper from a photosensitive drum, can also assume a similar construction.

While the embodiments of the present invention have been described, the present invention is not restricted to these embodiments, but can be modified in any way within the technical idea of the invention.

What is claimed is:

1. A fixing device comprising:

a fixing member for conveying a recording medium while holding the recording medium thereon, and fixing an image on the recording medium;

a separating member having a pivot shaft and urged against the surface of said fixing member;

a guide member provided downstream of said separating member with respect to the direction of movement of the recording medium for guiding the recording medium;

said separating member being of such a shape that the portion thereof from the leading end of the separating member to an imaginary line substantially perpendicular to the direction of movement of the recording medium and passing through said pivot shaft is substantially parallel to the direction of conveyance of the recording medium, and the portion thereof which is downstream of the imaginary line with respect to the direction of movement of the recording medium gradually becomes far from the movement path of the recording medium.

2. A device according to claim 1, further comprising a back-up member forming a nip with said fixing member, a separating member for said back-up member having a pivot shaft and urged against the surface of said back-up member, and a back-up side guide member provided downstream of said separating member for said back-up member with respect to the direction of movement of the recording medium for guiding the recording medium, said separating member for said back-up member being of such a shape that the portion thereof from the leading end of the separating member to an imaginary line substantially perpendicular to the direction of movement of the recording medium and passing through said pivot shaft is substantially parallel to the direction of conveyance of the recording medium, and the portion thereof which is downstream of the imaginary medium gradually becomes far from the movement path of the recording medium.

3. A device according to claim 1, wherein the shape of the portion of said separating member which is downstream of the imaginary line with respect to the direction of movement of the recording medium is arcuate.

* * * * *